United States Patent [19]

Thievessen et al.

[11] 4,339,094

[45] Jul. 13, 1982

[54] DEVICE FOR CHUCKING TUBULAR WINDING CORES

[75] Inventors: Karl Thievessen, Grevenbroich; Peter Weiss; Knut Welkers, both of Neuss, all of Fed. Rep. of Germany

[73] Assignee: Jagenberg Werke AG, Dusseldorf, Fed. Rep. of Germany

[21] Appl. No.: 165,901

[22] Filed: Jul. 3, 1980

[30] Foreign Application Priority Data

Jul. 24, 1979 [DE] Fed. Rep. of Germany ..... 2929934

[51] Int. Cl.[3] ..... B65H 75/24

[52] U.S. Cl. ..... 242/68.2; 242/72 R; 279/2 R

[58] Field of Search ..... 242/68.2, 72 R, 46.4, 242/46.5, 68.3; 279/2 R, 22, 30; 269/48.1

[56] References Cited

U.S. PATENT DOCUMENTS

| | | | |
|---|---|---|---|
| 1,072,067 | 9/1913 | Wild | 242/72 R |
| 3,198,454 | 8/1965 | Gorsek, Jr. et al. | 242/72 R X |
| 3,963,250 | 6/1976 | Flagg | 242/72 R |
| 3,993,317 | 11/1976 | Flagg | 242/68.2 X |

FOREIGN PATENT DOCUMENTS

| | | | |
|---|---|---|---|
| 550447 | 12/1957 | Canada | 242/46.4 |
| 2211518 | 9/1973 | Fed. Rep. of Germany . | |
| 2612375 | 10/1977 | Fed. Rep. of Germany . | |
| 2809947 | 9/1979 | Fed. Rep. of Germany | 242/72 R |
| 917978 | 2/1963 | United Kingdom | 242/46.4 |

*Primary Examiner*—John M. Jillions

*Attorney, Agent, or Firm*—Sprung, Horn, Kramer & Woods

[57] ABSTRACT

A device for chucking tubular winding cores, and particularly cores carrying paper webs or webs of similar material, wherein chucking segments forming a cylindrical surfaces are radially positioned by means of a core trunnion having an equilateral polygonal cross section, each of the chucking segments bearing on an individual surface of the trunnion through a support member having a rounded profile and producing a line contact. The support members are carried without play or with very little play in a cage inserted coaxially to be freely rotatable between the chucking segments and the core trunnion.

1 Claim, 4 Drawing Figures

FIG. 1
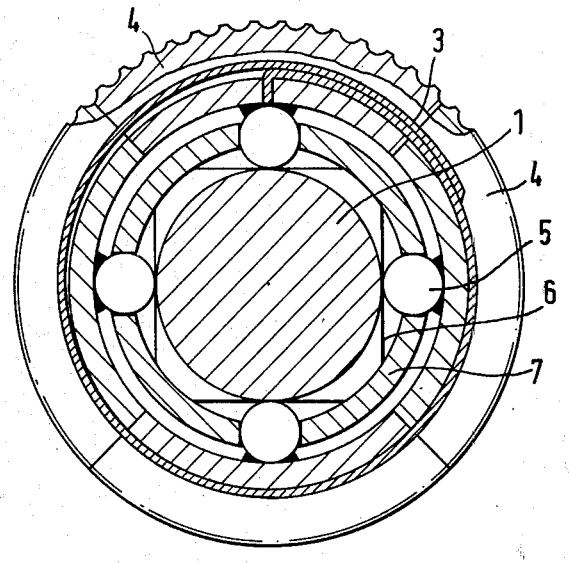
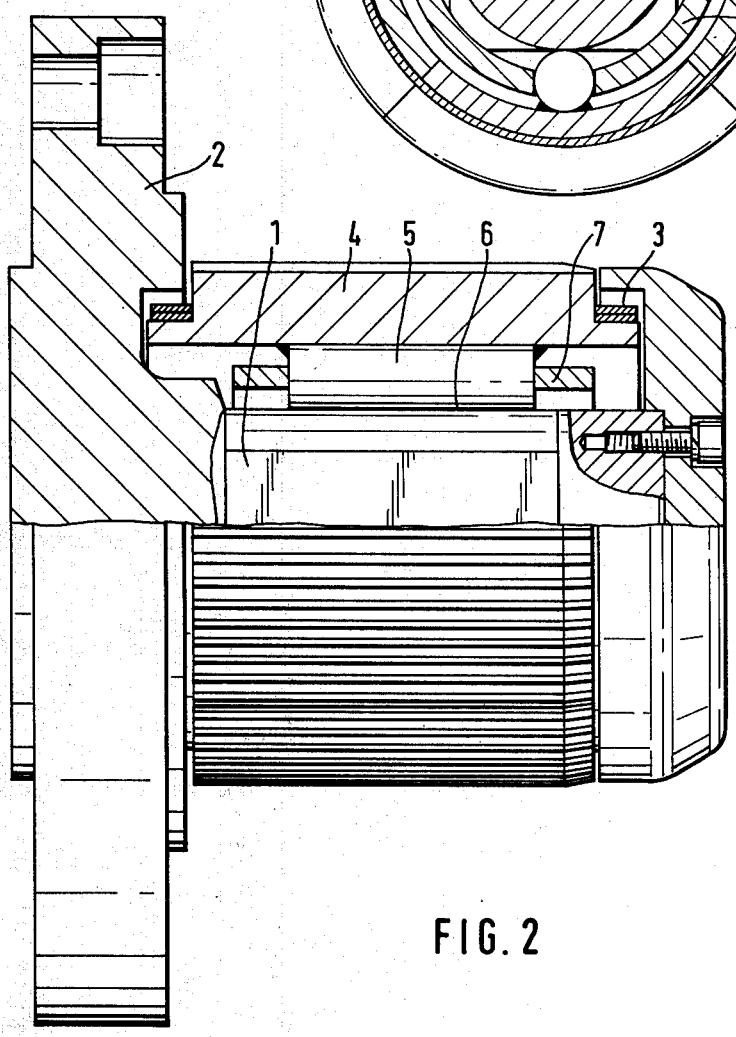
FIG. 2

DEVICE FOR CHUCKING TUBULAR WINDING CORES

BACKGROUND OF THE INVENTION

The invention relates to a device for the chucking of tubular winding cores, and particularly of cores carrying paper webs or webs of similar material, wherein chucking segments forming a cylindrical surface are radially positioned by means of a core trunnion having an equilateral polygonal cross section, each of said chucking segments bearing on an individual surface of said trunnion through a support member having a rounded profile and producing a line contact.

Expandable chucks of this type are inserted from both sides into the axial openings of winding cores and fixed therein by interlocking and operative engagement to prevent slippage between the chucks and the core as the web is being wound onto it or unwound from it. To provide a good grip, the chuck is seated in a segmented outer ring. In their normal position, the partly cylindrical chucking segments are forced radially inward by springs to abut on one another. The chuck is inserted in the core tube with the chucking segments in that position for interlocking engagement therewith. In winding the web onto the core or unwinding it therefrom, and also in braking the core, there is increased likelihood of slippage between the chucks and the core. The preclude this, the chucks are expanded in that the chucking segments are spread radially outward, by the effect of the forces generated by the web tension or the braking action, to provide in addition to the interlocking engagement also operative engagement with the core tube.

In a prior-art device of the type outlined above and shown in (German patent application DOS No. 22 11 518, this is accomplished in that the chucking segments upon the occurrence of a tangential force at the chuck are deflected from their normal position, imposed on them by the spring. As the support member disposed on the chucking segment slides along the surface of the core trunnion, it causes the chucking segment on which the force is acting to expand radially and so to become lodged more securely in the winding core.

It has now been found that this design has the drawback that in practice the only chucking segment that is deflected is the one on which the web-tension or braking force is acting. The other chucking segments distributed over the circumference of the chuck are not deflected. This leads to increased abrasion at the inner circumference of the winding core, with the abraded particles settling between the chucking segments, thus impairing their ability to move, with the result that ultimately the chucking segments will be unable to return into their normal position and the chuck then cannot readily be withdrawn from the winding core. In any event, such fouling will call for frequent cleaning of the chucks if they are to be kept in good working condition.

SUMMARY OF THE INVENTION

The present invention has as its object to secure that all chucking segments expand as nearly uniformly and to the same degree as possible upon the occurrence of a force acting on one of them in order to achieve uniform bearing pressure of the chuck on the entire inner circumference of the winding core and to lessen, through the reduced bearing pressure then required, the abrasion on the winding core.

As an improvement to the device known from said earlier application, it is proposed, in accordance with the invention, that the support members be carried without play or with very little play in a cage inserted coaxially to be freely rotatable between the chucking segments and the core trunnion.

Any motion of any of the support members will then be transmitted by the cage to the other support members, thus producing uniform expansion of the chucking segments regardless of where on its circumference the chuck is being acted on by a force.

In an advantageous embodiment of the device in accordance with the invention, the support members are sliding or rolling elements in the form of balls or rollers. The sliding elements may be either integral with the chucking segments or rigidly fastened to them. The rolling elements are carried for line contact in conical recesses made to tight tolerances in the inner circumference of the chucking segments in such a way that the rolling elements do not make contact with the bottom of the recess.

To assure good guidance of the sliding or rolling elements on the surface of the core trunnion, tracks are preferably provided in the sliding surfaces of the trunnion.

BRIEF DESCRIPTION OF THE DRAWINGS

The invention will now be described in greater detail with reference to the embodiments illustrated in the accompanying drawings, wherein:

FIG. 1 is a partial cross-sectional view;

FIG. 2 is a view in partial longitudinal section of one embodiment;

DETAILED DESCRIPTION OF THE INVENTION

Figure 3:
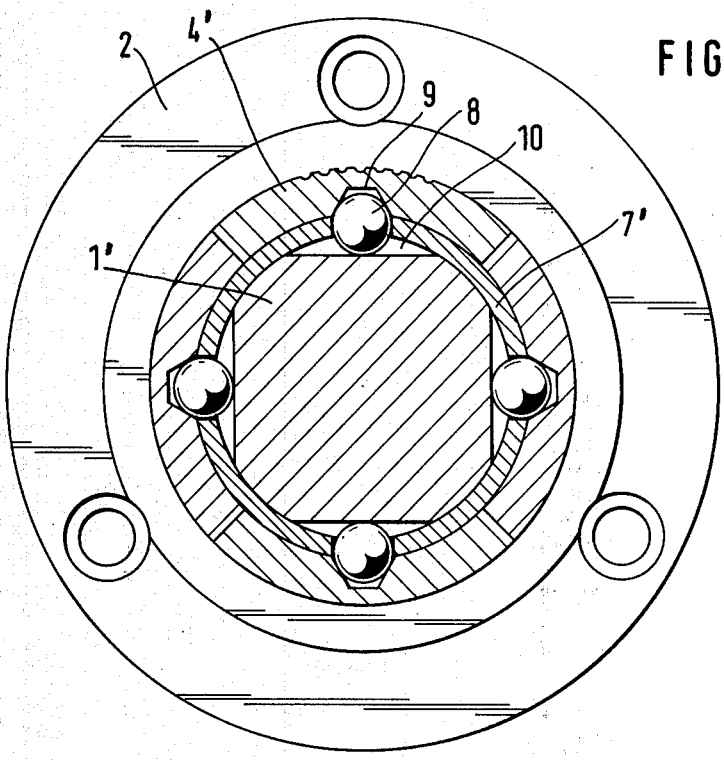
FIG. 3 is a partial cross-sectional view.

The device comprises a core trunnion 1 with square cross section with which a flange 2 is integral which is engaged by a brake (not shown). Disposed about the core trunnion 1 are four chucking segments 4 having a fluted, knurled or serrated outer circumference which are held together and in contact with one another by a spring 3.

In the embodiment shown in FIGS. 1 and 2, the support members are sliding elements 5 which are welded onto the inner circumference of the chucking segments 4 and are adapted to slide on the surfaces 6 of the core trunnion 1. The sliding elements 5 are disposed in recesses made to tight tolerances in the cage 7, which is coaxially inserted to be freely rotatable between the chucking segments 4 and the core trunnion 1.

Now when a force is acting in the tangential direction on one of the chucking segments 4, the sliding element 5 fixed to it will slide on the surface 6 of the core trunnion 1, thus causing the segment 4 to expand radially outwardly. The cage 7 assures that not only the sliding element 5 on whose associated chucking segment 4 the force is acting slides on the surface 6 of the trunnion 1 but that the sliding elements 5 of all other chucking segments 4 are entrained along with it so that all four chucking segments 4 spread outwardly simultaneously and uniformly. This results in better pressure distribution between the trunnions and the winding core.

Figure 4:
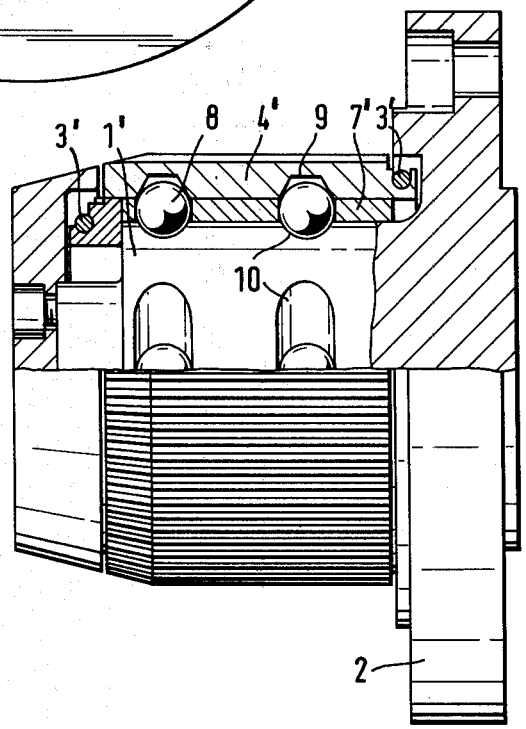
FIG. 4 a view in partial longitudinal section of another embodiment of the device in accordance with the invention.

In the embodiment shown in FIGS. 3 and 4, the sliding elements 5 of the embodiment according to FIGS. 1 and 2 are replaced with rolling elements 8, and more particularly balls. In contrast to the rigid connection between the sliding elements 5 and the chucking segments 4 in the embodiment according to FIGS. 1 and 2, the rolling elements 8 in the embodiment shown in FIGS. 3 and 4 are free to turn in recesses made to tight tolerances in the cage 7'. The rolling elements 8 are set into conical recesses 9 in the inner surface of the chucking segments 4' held in place by springs 3' in such a way that they make contact with the lateral surfaces of the conical recesses 9 but not with their bottoms.

In the embodiment according to FIGS. 3 and 4, the plane surfaces on the core trunnion 1' are replaced with the grooves 10. In place of the balls 8, rollers whose axes extend in the axial direction of the core trunnion 1' may be used as rolling elements, in which case the cage 7' would have to be provided with appropriate recesses and the trunnion 1' with appropriate grooves 10.

It will be appreciated that the instant specification and claims are set forth by way of illustration and not limitation and that various changes and modifications may be made without departing from the spirit and scope of the present invention.

What is claimed is:

1. In a device for chucking tubular winding cores of the type wherein chucking segments forming a cylindrical surface are radially positioned by a core trunnion having an equilateral polygonal cross section, each of said chucking segments bearing on an individual surface of said trunnion through a support member having a rounded profile and producing a line contact, the improvement wherein: the support members comprise rollable balls and means mounting same between the chucking segments and the core trunnion with substantially no play comprising conical recesses in the inner circumference of the chucking segments configured to receive the balls to make contact with only the side walls thereof with substantially no play, tracks in the surface of the core trunnion for receiving the balls and a cage for the balls disposed coaxially between the chucking segments and the core trunnion for free rotation and receiving said balls with substantially no free play.

* * * * *